US006914579B2

(12) United States Patent
Schadler

(10) Patent No.: US 6,914,579 B2
(45) Date of Patent: Jul. 5, 2005

(54) APPARATUS AND METHOD FOR ISOLATING IN-CHANNEL FM ANTENNAS SHARING COMMON APERTURE SPACE

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/396,818

(22) Filed: Mar. 26, 2003

(65) Prior Publication Data

US 2004/0189540 A1 Sep. 30, 2004

(51) Int. Cl.[7] ..... H01Q 1/12
(52) U.S. Cl. ..... 343/890
(58) Field of Search ..... 343/890, 891, 343/892, 893, 700 MS; 348/723, 728, 908; 333/1.1, 132

(56) References Cited

U.S. PATENT DOCUMENTS 5,774,193 A * 6/1998 Vaughan ..... 348/723
5,949,793 A * 9/1999 Bossard et al. ..... 370/487
6,137,448 A 10/2000 Schadler ..... 343/770
6,422,900 B1 * 7/2002 Hogan ..... 439/578
6,608,592 B2 * 8/2003 McReynolds ..... 342/418
6,677,916 B2 * 1/2004 Skalina et al. ..... 343/890
2002/0187759 * 12/2002 Stenberg ..... 455/117
2004/0008150 * 1/2004 Harland et al. ..... 343/797

* cited by examiner

*Primary Examiner*—Minh A
(74) *Attorney, Agent, or Firm*—Baker & Hostetler LLP; Jonathan A. Kidney

(57) ABSTRACT

Each of a pair of antennas for broadcasting has multiple elements arranged vertically on the same tower. The antennas transmit circularly polarized signals of opposite polarization. The opposite circular polarization of the radiated signals increases their mutual isolation and permits broadcast of conventional FM-band signals and digital FM at the same frequency. The polarization technique allows the elements of the two antennas to share an aperture without degradation of function.

25 Claims, 5 Drawing Sheets

APPARATUS AND METHOD FOR ISOLATING IN-CHANNEL FM ANTENNAS SHARING COMMON APERTURE SPACE

FIELD OF THE INVENTION

The present invention relates generally to radio frequency electromagnetic wave (RF) transmission equipment. More particularly, the present invention relates to an apparatus and method for broadcasting two FM radio signals at the same frequency using the same aperture space.

BACKGROUND OF THE INVENTION

FM radio is in wide use in the field of radio broadcast. The term FM includes, for example, any of the Frequency Modulation methodologies used or developed for signal broadcasting in a frequency band assigned by the U.S. Federal Communications Commission (FCC), nominally in the transmission range 88 MHz to 108 MHz, which is near the middle of the Very-High-Frequency (VHF) television broadcast band. These Frequency Modulation technologies include both analog FM and digital FM.

The radio industry and the FCC have at present standardized on the iBiquity® IBOC (In-Band-On-Channel) hybrid analog-digital transmission system. This system permits FM stations in the U.S. to broadcast analog and digital signals simultaneously on their currently allocated channel frequency, if they use a single antenna to perform the simulcast.

At present, all U.S. FM radio transmission channels are 200 KHz wide, with standard analog FM broadcast modulation occupying only the center 100 KHz of the channel and with the IBOC signal using the outer 50 KHz on each side of the analog part of the channel. This characteristic of the IBOC signal imposes a need for sharp-cutoff filters to maintain signal separation, both between adjacent channels and between the analog and digital portions of the transmission on a single channel.

As an additional consideration, the FCC stipulates that the transmitted digital signal is to be 20 dB lower in signal strength than the analog signal. This may intrinsically place the digital transmitting antenna in a field as much as 10 times stronger than its own transmission.

One method of achieving an IBOC simulcast is to use two separate transmission systems feeding into two separate antennas on a single tower. Since the vertical position at which an antenna is mounted on a tower directly affects the antenna's achieved coverage, it would be desirable to collocate the analog and digital antennas not only on the same tower, but also at the same height above the ground. Further, since the azimuth pattern of an FM antenna is highly dependent on the interaction between the radiating device and the cross section of the tower structure, it would be desirable to mount both the analog and digital antennas in the same orientation to the tower.

When adding digital FM coverage to towers already in use for analog FM, a concern arises because many towers are full—that is, the towers have no additional aperture space available—so that some FM broadcasters may be required to interleave a second antenna within the aperture of their existing antenna. This introduces a challenge, because the analog and digital signals occupy the same segment of the frequency spectrum, yet are required to be isolated from each other. The current requirement for isolation between the IBOC digital signal and the analog signal is on the order of 35 dB. If the IBOC and analog antennas are to share the aperture, it is desirable to provide satisfactory isolation so that filtering requirements are kept within desirable ranges.

Accordingly, there is a need in the art for a method and apparatus to achieve isolation between separate in-channel FM antennas sharing common aperture space.

SUMMARY OF THE INVENTION

Preferred embodiments of the method and apparatus achieve isolation at least to some degree between separate in-channel FM antennas sharing common aperture space, employing two antennas that are circularly polarized with opposite orientations.

In a first aspect, an enhanced-isolation shared-aperture digital and analog FM antenna pair is comprised of two independent circularly-polarized FM transmitting antennas on a tower. In another aspect, each of the two antennas has at least one element, where each element of each antenna can radiate a circularly-polarized RF broadcast signal. In still another aspect, each of the two antennas has a plurality of substantially identical, independently-mounted, individually driven elements spaced vertically along the tower. In yet another aspect, elements of one of the antennas are symmetrical and opposite to the elements of the other antenna, so that the elements of one of the antennas, when driven, radiate a left-hand circularly polarized signal, and the elements of the other antenna, when driven, radiate a right-hand circularly polarized signal. In another aspect, the locations of the elements comprising the first antenna are interleaved with the locations of the elements comprising the second antenna.

In another aspect, an apparatus for transmitting digital and analog FM radio signals from a common aperture space comprises means for radiating a first FM signal with a first circular polarization and means for radiating a second FM signal with a second circular polarization opposite to that of the first signal. Such an apparatus may be further comprised of means for accepting a first broadcast-level signal from a transmission line and means for distributing the energy of the first broadcast-level signal among multiple transmitting elements with signal-level balance and phase relationships required to create a first circularly-polarized transmission, as well as means for accepting a second broadcast-level signal from a transmission line and means for distributing the energy of the second broadcast-level signal among multiple transmitting elements with the signal-level balance and phase relationships required to create a second circularly-polarized transmission with polarization opposite to that of the first signal.

In yet another aspect, a method for simulcasting analog and digital FM broadcasts from a single aperture space comprises the steps of driving a first antenna with a first circularly-polarized signal at a particular channel frequency and driving a second antenna with a second circularly-polarized signal at the same channel frequency, where one of the signals is an analog transmission and the other is a digital transmission, and where the polarizations of the two signals are opposite.

There have thus been outlined, rather broadly, the more important features of the invention, in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
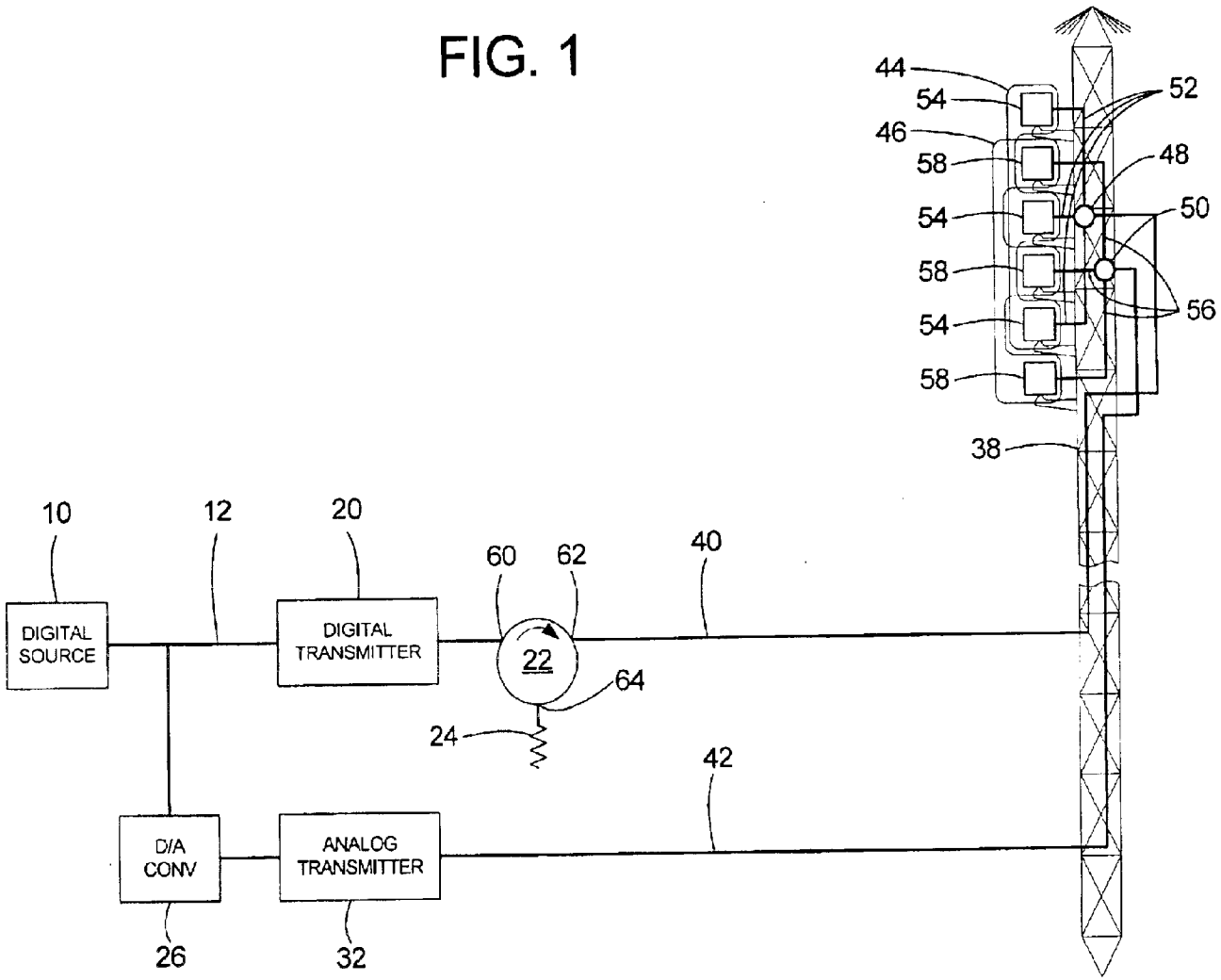
FIG. 1 is a schematic diagram of a transmission system combining analog and digital FM radio broadcast signals in an IBOC environment.

Preferred embodiments of the invention provide a method and apparatus for achieving isolation at least to some extent between separate in-channel FM antennas sharing common aperture space. Preferred embodiments of the invention will be described with reference to the figures, in which like reference numerals refer to like elements throughout.

FIG. 1 shows an FM radio transmission system including a single content source feeding two complete signal paths. A digital programming source 10 provides a digital signal stream 12. The digital signal stream 12 feeds a digital transmitter 20 directly. The output of the digital transmitter 20 feeds a circulator 22 with an associated dummy load 24.

After processing of the digital signal stream 12 with digital-to-analog conversion 26 (D/A), the analog signal feeds an analog transmitter 32. The full-power analog signal may drive its antenna 46 without a circulator, since its signal level is far higher than the digital signal level under current FCC regulations and the added isolation is superfluous.

The digital transmitter 20 and analog transmitter 32 outputs can send their respective signals independently up a tower 38 using a digital signal coax 40 and an analog signal coax 42. Once the digital and analog signals are present near the digital and analog transmitting antennas 44 and 46, they may be fed into a passive digital power divider 48 and a passive analog power divider 50, respectively, in a configuration known in the art as branch or corporate feed. The outputs of the digital power divider 48 are distributed, using individual digital feed lines 52 that are preferably equal in length, to the respective digital antenna elements 54. Similarly, the outputs of the analog power divider 50 are distributed, using individual analog feed lines 56 that are preferably equal in length, to the respective analog antenna elements 58.

A power divider, as the term is used here, is for example a passive device that divides an input into a series of lower-energy duplicates of the original signal, in phase with each other but delayed by the intrinsic propagation time of the device. The exact timing of each of the divided signals may be adjusted with respect to the others by precise control of the length of the feed coax from the power divider to the individual radiating elements. Making the delays to the individual radiating elements unequal can adjust the beam tilt—the energy distribution as a function of the angle to the horizontal—of the radiated signal, and thereby affect the signal's reception range.

A circularly polarized signal transmitted as described above is detectable either by a suitable circularly polarized receiving antenna, namely one with the same handedness as the transmitting antenna, or by a linearly polarized receiving antenna, which has less gain with respect to the signal than does a same-handed circularly polarized antenna, but far higher gain with respect to the signal than does an oppositely-handed circularly polarized receiving antenna.

Figure 2:
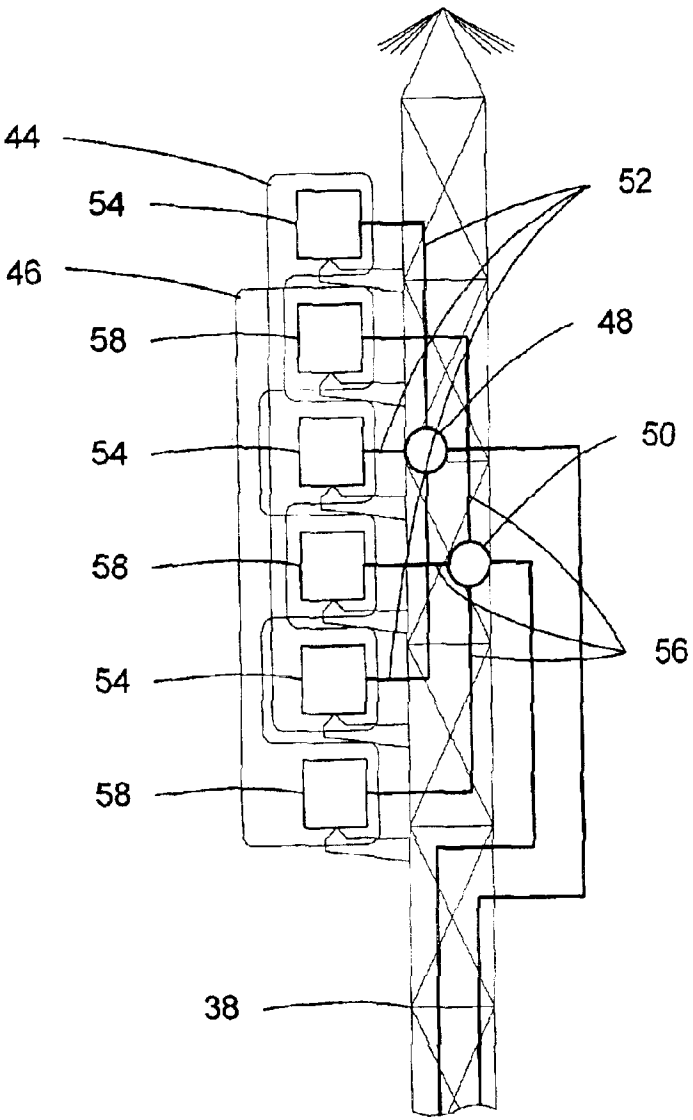
FIG. 2 is a more detailed view of the two antennas and the associated tower-top apparatus used for a combined IBOC dual broadcast system.

FIG. 2 provides a more detailed view of the items located at the top of the tower 38. A feed from the digital signal power divider 48 via digital signal coaxial feed lines 52 energizes digital radiating elements 54. Similarly, a feed from the analog power divider 50 via analog signal coaxial feed lines 56 energizes analog signal radiating elements 58.

Figure 3:
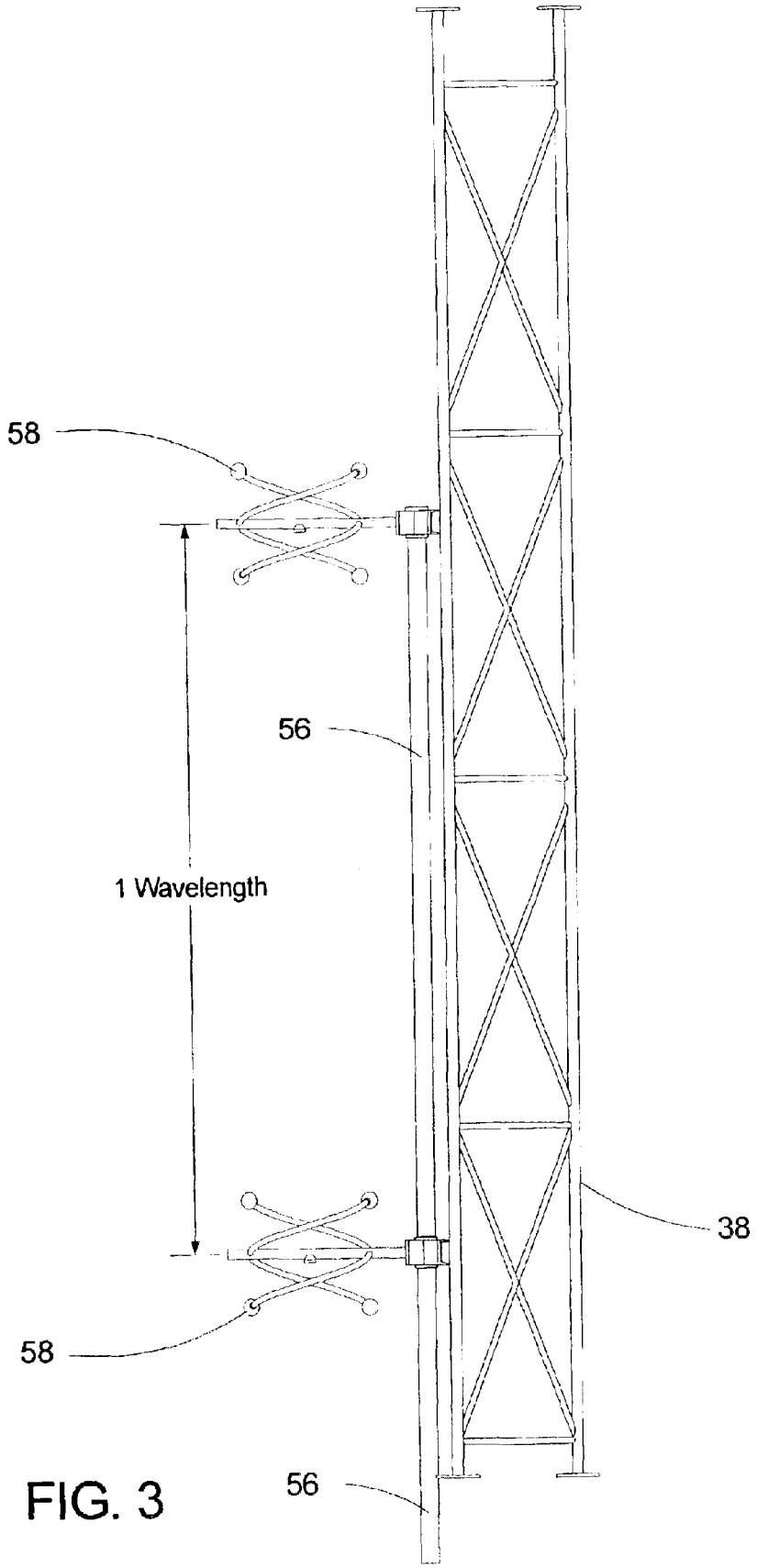
FIG. 3 is a diagram of a single circularly polarized multi-element antenna for use in an analog-only or a digital-only (non-IBOC) environment.
Figure 4:
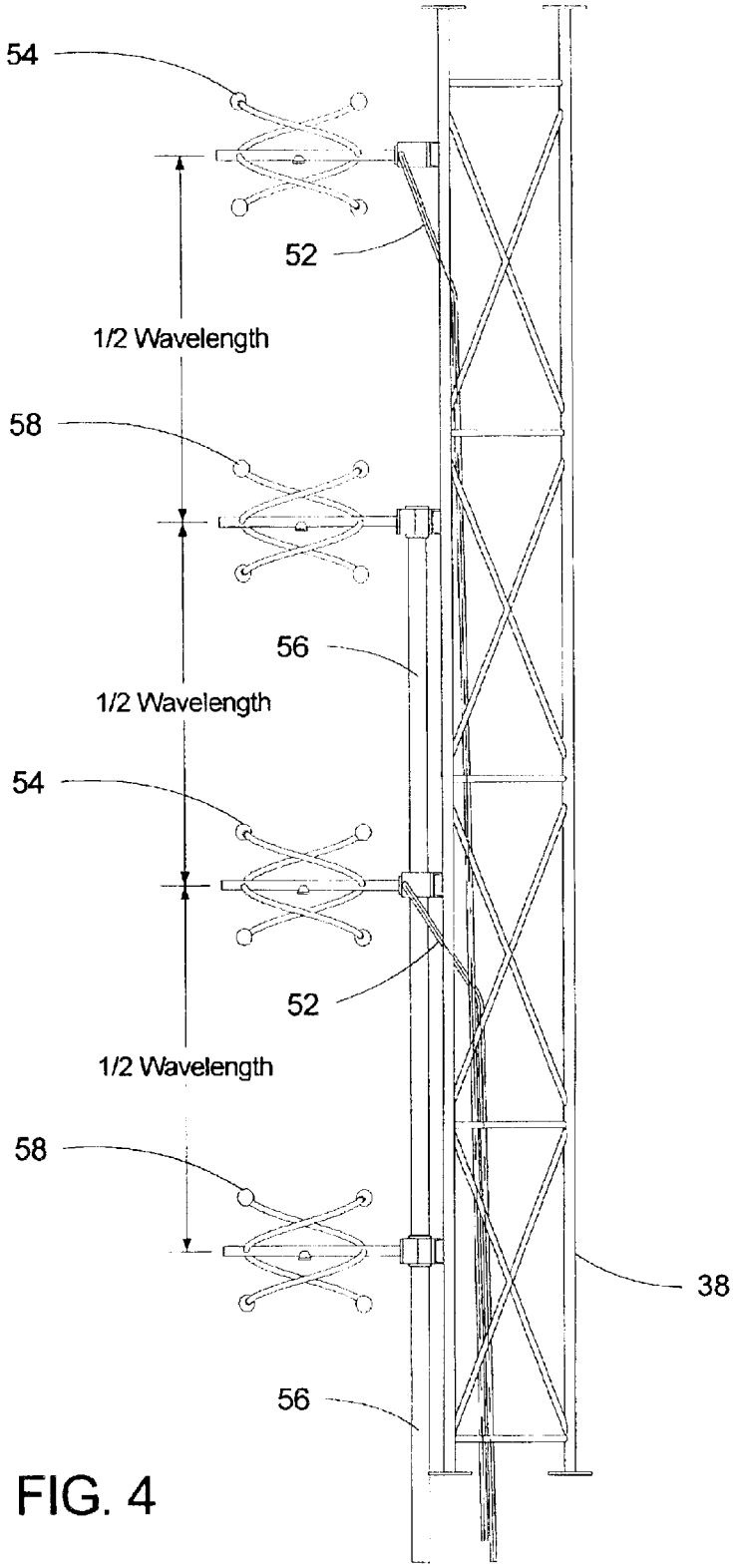
FIG. 4 is a diagram of an interleaved pair of circularly polarized multi-element antennas configured for opposite-polarization transmission in an IBOC environment.
Figure 5:
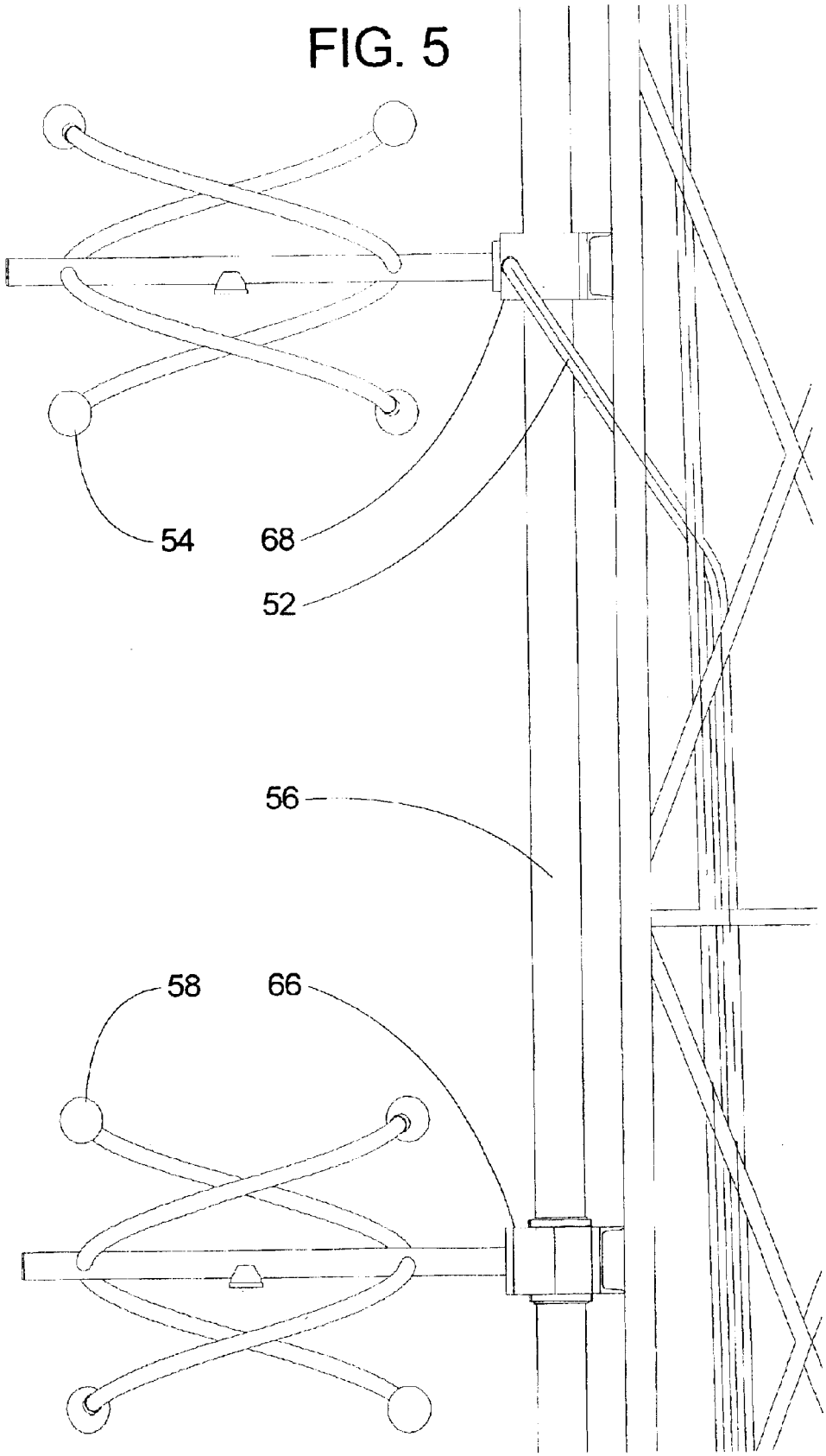
FIG. 5 is more detail view of diagram of FIG. 4.

The signal energy may also be distributed directly up the tower 38 with tee junctions, a configuration known in the art as series feed, illustrated in FIG. 3, which shows a single, non-IBOC antenna. FIG. 4 adds a second radiating arrangement of opposite polarization to form an IBOC-compliant combination. FIG. 4 shows on the lower of the two digital elements 54 a fitting that attaches the lower digital element 54 to the tower 38 while passing around and making no electrical contact with the analog coaxial line 56. FIG. 5 shows the same elements enlarged, with the antenna coupling fitting 66 coupling the analog coax 56 to an analog antenna element 58 and the bypass fitting 68 allowing a digital antenna element 54 to be mounted in its preferred location without electrical contact to the analog coax. The digital elements 54 in FIG. 4 are fed by separate coaxial lines within the figure; whether their feed is series or branch is not shown. Series feed causes each of the elements to be excited with a signal delayed by one cycle from the previous element, a characteristic that can have no appreciable effect on the received FM radio signal. The difference shown in FIGS. 3 and 4 in the relative size of the analog coaxial line 56 and the digital coaxial lines 52 illustrates the hundredfold greater power that can be present in an IBOC-compliant system's analog signal. This power differential can permit a preferred embodiment for the digital signal to incorporate a smaller, lower-cost coaxial line with reduced wind loading, fewer joints, and easier installation, yet meet system requirements.

Where the elements 58 of the analog antenna are spaced one wavelength apart as shown in FIG. 3, the analog output comprises a single circularly polarized transmission with acceptable uniformity around the tower 38 (that is, a substantially omnidirectional radiation pattern) despite the presence of the conductive tower structure. Polarization may be a function of antenna element 58 design, so that similar antenna elements of opposite handedness will radiate circularly polarized right-handed or left-handed signals.

Variations in vertical spacing between elements 58 can determine in part the characteristics of the beam pattern generated. Elements 58 spaced uniformly at one wavelength increments can produce a pattern at right angles to the tower, while elements 58 with spacing other than one wavelength, such as 9/10, 4/5, 3/4, and the like, can be used to reduce excessive upward radiation.

FIG. 4 illustrates the interleaving of digital antenna elements 54 at one-half-wavelength spacing with respect to the analog elements 58, which establishes one-wavelength spacing between the digital antenna elements 54 themselves. This places the center of the aperture for the digital antenna within the aperture of the analog antenna, and nearly coincident with the center of the analog aperture. If the digital antenna elements 54 are designed to radiate a circularly polarized signal of opposite polarity to the corresponding analog apparatus, then there can be an intrinsic improvement, for example on the order of 10 dB, in the isolation between the digital and analog transmissions when compared to using two antennas of like placement but with the same polarization as each other. This represents a significant portion of the isolation required for collocated transmitting antennas at the same frequency, and can help reduce the filter and circulator hardware size and cost that would otherwise be required in implementing an IBOC system.

Spacing the digital antenna elements 54 equidistant between the proximate analog antenna elements 58 shown in FIG. 4 can minimize coupling of the analog signal to the digital line, which can in turn minimize the size of the apparatus needed in order to remove the signals coupled thereto.

In the example in FIGS. 3 and 4, two elements of each of the digital antenna 44 and the analog antenna 46 of FIG. 1 are shown. Each element operating alone can create a circularly polarized signal, while adding more elements can increase range by increasing total radiated power capability and by increasing the directivity of the radiation pattern. Using a larger number of elements, for example up to about twelve in each antenna, is useful in some environments and will typically produce improved performance. Using large numbers of elements may incur greater complexity and necessarily takes up more physical height, the latter of which translates to a greater share of the typically limited aperture space within the confined environment of a transmission tower 38.

Alternative embodiments of the invention may use only one element per antenna. In such embodiments, the apertures by definition do not overlap.

Achievement of the full 35 dB of isolation between the analog and digital transmissions in an IBOC system may require that the intrinsic 12 dB isolation of the two signals and the added 10 dB gained through use of oppositely polarized antennas be augmented by the use of a circulator or equivalent function in the digital transmitter signal path.

Circulators, such as the digital signal path component 22 in FIG. 1, are passive devices that can allow RF signals to advance one node around a directional multi-port fitting with acceptable power losses. Following the digital signal path in FIG. 1, outgoing RF from the digital transmitter 20 is allowed by the circulator 22 to advance from that circulator's first port 60 to its second port 62, which leads to the digital-signal transmission line 40. The digital-signal transmission line 40 in turn leads to the digital-signal antenna 44. Coupled energy from the analog antenna 46, as well as returning RF from other sources, such as reflections from connectors, antenna mismatches, and the like can travel in the direction opposite to the transmitted signal in the digital-signal transmission line 40. Such energy reenters the circulator at its second port 62 and advances to its third port 64, having been deflected by the circulator 22 from the digital-signal transmitter 20. The third circulator port 64 feeds to a dummy load 24, which transforms the unwanted energy to heat.

Since the digital signal may be 20 dB lower in signal strength than the analog signal, and the 12 dB intrinsic isolation and 10 dB added isolation of the invention may further attenuate digital signal energy coupled to the analog path, a circulator placed in the analog signal path may not be needed for a preferred embodiment.

Numerous styles of antenna elements can intrinsically radiate circularly polarized signals and are thus suitable for simulcasting an analog and a digital signal in a single aperture. Still other styles that do not intrinsically radiate circularly polarized signals can be forced to create such signals when driven by properly configured signals. Any pairs of antennas composed of a plurality of elements per antenna, capable of being configured to radiate oppositely circularly polarized signals, and further capable of being interleaved on a tower with their electrical centers located within +/−2 meters of each other, can potentially be incorporated into a system as described in the present invention.

A preferred embodiment of the invention uses ring-style antennas. In this embodiment, the helical direction in which the dipoles comprising the separate circularly polarized ring-style antenna elements are wound is opposite between the digital and analog antennas, effectively interleaving right-hand and left-hand polarized antennas in the same aperture. This achieves the required high level of isolation between the antennas collocated in the aperture.

Unlike the situation for broadcast television, current FCC regulations on FM radio transmission (e.g. 47 CFR 73.316) do not distinguish between right-hand and left-hand circular polarization. While horizontal polarization is standard, either right-hand or left-hand circular polarization is an acceptable alternative under current FCC regulations, as long as the total effective radiated power remains within the licensed limit. Further, it can be demonstrated that a right-hand circularly polarized antenna will exhibit significant rejection of any left-hand polarized signal and vice versa. This observation leads to an approach to increasing isolation.

An inherent advantage to increasing the isolation between the antennas is a reduction in mutual coupling. When a high level of isolation exists, the second antenna can be placed in the aperture of an existing antenna with minimal effect on the match of the existing antenna, thus potentially reducing field adjustment after installation. Since field adjustment may require repeatedly climbing the tower, energizing and deenergizing the transmitters, and painstakingly adjusting the apparatus, the process may be time consuming and costly. As such, it should be avoided if such avoidance is practical.

In comparison to more conventional techniques, interleaving oppositely-circularly-polarized antennas within an aperture can, in some embodiments, achieve an extra 10 dB of isolation.

Although the preferred embodiment is described for use with FM radio, application of the invention to other frequency bands and other modulation methodologies is possible.

The many features and advantages of the invention are apparent from the detailed specification, and thus, it is intended by the appended claims to cover all such features and advantages of the invention that fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An enhanced-isolation shared-aperture digital and analog FM antenna pair comprising:

a first independent FM transmitting antenna located in an aperture space on a tower, wherein the first antenna has a plurality of elements and has a first orientation of polarization; and a second independent FM transmitting antenna interleaved principally within the same aperture space of the first antenna, wherein the second antenna has a plurality of elements and has a second orientation of polarization different from the orientation of polarization of the first antenna, so as to increase signal isolation between the second antenna and the first antenna.

2. The antenna pair of claim 1, wherein the first antenna comprises a first plurality of individually driven first elements interleaved vertically along the tower so that the first elements, when driven, radiate a single first polarized transmitted signal.

3. The antenna pair of claim 1, wherein the second antenna comprises a second plurality of individually driven second elements interleaved vertically along the tower so that the second elements, when driven, radiate a single second polarized transmitted signal.

4. The antenna pair of claim 1, wherein the elements comprising the first antenna have symmetrical and opposite physical arrangement to the elements comprising the second antenna.

5. The antenna pair of claim 1, wherein the elements of the first of the two antennas, when driven, radiate a right-hand circularly polarized signal, and the elements of the second antenna, when driven, radiate a left-hand circularly polarized signal.

6. The antenna pair of claim 4, wherein the elements of the first of the two antennas, when driven, radiate a right-hand circularly polarized signal, and the elements of the second antenna, when driven, radiate a left-hand circularly polarized signal.

7. The antenna pair of claim 1, wherein the first elements comprising the first antenna are interleaved with the second elements comprising the second antenna.

8. The antenna pair of claim 1, further comprising:

a first power divider and associated first coaxial lines that establish the phase relationship between the first elements comprising the first antenna of the pair; and a second power divider and associated second coaxial lines that establish the phase relationship between the second elements comprising the second antenna of the pair.

9. The antenna pair of claim 1, further comprising:

an analog coaxial feed line feeding said analog antenna;

a first analog-signal tee junction in said analog-signal coaxial feed line distributing analog signal energy among the elements comprising said analog antenna;

a first analog-signal subordinate coaxial line coupling analog-signal energy from said first analog-signal tee junction to a first analog antenna element; and a second analog-signal subordinate coaxial line coupling analog-signal energy from said first tee junction to a second analog antenna element.

10. The antenna pair of claim 1, further comprising:

a digital coaxial feed line feeding said digital antenna;

a first digital-signal tee junction in said digital-signal coaxial feed line distributing digital signal energy among the elements comprising said digital antenna;

a first digital-signal subordinate coaxial line coupling digital-signal energy from said first digital-signal tee junction to a first digital antenna element; and a second digital-signal subordinate coaxial line coupling digital-signal energy from said first digital-signal tee junction to a second digital antenna element.

11. The antenna pair of claim 1, wherein the centers of radiation of the antennas comprising the pair are separated by a distance approximating one-half wavelength of the center frequency of the broadcast channel to which the antennas are tuned.

12. The antenna pair of claim 1, wherein the centers of radiation of the antennas comprising the pair are separated by a distance approximating one half of the center-to-center distance between the elements comprising the first antenna of the pair.

13. The antenna pair of claim 1, wherein the center of radiation of the second antenna is located within the aperture of the first antenna.

14. The antenna pair of claim 1, wherein the elements comprising the first antenna and the second antenna are polarized ring style antenna elements.

15. The antenna pair of claim 1, wherein the spacing between successive elements of the first antenna is one wavelength of the center frequency of the broadcast channel to which the antennas are tuned.

16. The antenna pair of claim 1, wherein the spacing between successive elements of the first antenna is a uniform value different from one wavelength of the center frequency of the broadcast channel to which the antennas are tuned.

17. The antenna pair of claim 1, wherein the spacing between successive elements of the second antenna is the same as the spacing between successive elements of the first antenna.

18. The antenna pair of claim 1, wherein the distance between each element of the first antenna and any elements of the second antenna proximal thereto is uniform.

19. The antenna pair of claim 1, wherein all of the elements comprising the first and second antennas are attached to a common supporting tower with substantially identical orientation with respect to the cross section of the tower.

20. An apparatus for transmitting digital and analog FM radio signals from a common aperture space, comprised of:

means for radiating a first FM signal with a first polarization; and means for radiating a second FM signal with a second polarization different from that of the first signal, wherein the first and second radiating means are interleaved within the same aperture space and the different polarizations increases signal isolation between the radiating means.

21. The transmitting apparatus of claim 20, further comprising:

means for accepting a first broadcast-level FM radio signal from a first transmission line; and means for distributing the energy of the first broadcast-level FM radio signal among multiple transmitting elements to create a first polarized transmission.

22. The transmitting apparatus of claim 20, further comprising:

means for accepting a second broadcast-level signal from a second transmission line; and means for distributing the energy of the second broadcast-level signal among multiple transmitting elements to create a second polarized transmission with polarization different from that of the first signal.

23. A method for simulating analog and digital FM broadcasts from a single aperture space comprising the steps of:

vertically interleaving a second antenna within a same aperture space of a first antenna;

driving the first antenna with a first polarized FM signal; and driving the second antenna with a second polarized FM signal, where the polarizations of the two signals are different, so as to increase signal isolation between the antennas.

24. The method of claim 23, further comprising the steps of:

accepting a first broadcast-level signal from a first transmission line; and distributing the energy of the first broadcast-level signal among multiple transmitting elements to create a first polarized transmission.

25. The method of claim 23, further comprising the steps of:

accepting a second broadcast-level signal from a second transmission line; and distributing the energy of the second broadcast-level signal among multiple transmitting elements to create a second polarized transmission with polarization different from that of the first signal.

* * * * *